US011131274B1

(12) United States Patent
Krup

(10) Patent No.: US 11,131,274 B1
(45) Date of Patent: Sep. 28, 2021

(54) INDIVIDUAL CYLINDER TUNING BOOSTER FOR A CARBURETOR

(71) Applicant: William R. Krup, Mt. Carmel, IL (US)

(72) Inventor: William R. Krup, Mt. Carmel, IL (US)

( * ) Notice: Subject to any disclaimer, the term of this patent is extended or adjusted under 35 U.S.C. 154(b) by 0 days.

(21) Appl. No.: 16/700,893

(22) Filed: Dec. 2, 2019

Related U.S. Application Data

(63) Continuation-in-part of application No. 16/210,978, filed on Dec. 5, 2018, now Pat. No. 10,830,183.

(51) Int. Cl.

| | |
|---|---|
| ***F02M 19/12*** | (2006.01) |
| ***F02M 17/48*** | (2006.01) |
| ***F02M 19/10*** | (2006.01) |
| ***B01F 3/04*** | (2006.01) |
| ***F02M 9/08*** | (2006.01) |
| ***F02M 19/03*** | (2006.01) |
| ***F02M 9/127*** | (2006.01) |

(52) U.S. Cl.
CPC ..... *F02M 19/03* (2013.01); *B01F 3/04* (2013.01); *F02M 9/085* (2013.01); *F02M 9/1275* (2013.01); *F02M 17/48* (2013.01); *F02M 19/10* (2013.01)

(58) Field of Classification Search
CPC ..... F02M 9/1275; F02M 9/085; F02M 17/48; F02M 19/10; B01F 3/04
See application file for complete search history.

(56) References Cited

U.S. PATENT DOCUMENTS

| | | | | |
|---|---|---|---|---|
| 1,301,483 | A * | 4/1919 | Miller et al. | F02M 7/133 261/41.1 |
| 1,758,954 | A | 5/1930 | Linn | |
| 2,255,296 | A | 9/1941 | Moseley | |
| 2,457,570 | A | 12/1948 | Leibing | |
| 3,847,125 | A | 11/1974 | Malherbe | |
| 3,873,650 | A | 3/1975 | Lamkin | |
| 4,375,438 | A | 3/1983 | McKay | |

* cited by examiner

*Primary Examiner* — Robert A Hopkins
(74) *Attorney, Agent, or Firm* — Stinson LLP

(57) ABSTRACT

A fuel discharge nozzle for discharging fuel into an airflow passageway of a barrel of a carburetor includes a nozzle body that is attached to the carburetor and has proximal and distal ends. The nozzle body defines a fuel inlet that receives fuel, a fuel outlet that permits the fuel to flow out of the nozzle body, and a fuel passage fluidly connecting the fuel inlet and the fuel outlet so that the fuel can flow from the fuel inlet to the fuel outlet. The nozzle body is sized and shaped to position the fuel outlet in the airflow passageway of the barrel of the carburetor when the nozzle body is attached to the carburetor so that the fuel flows into the airflow passageway of the carburetor and mixes with air after the fuel flows out of the fuel outlet.

18 Claims, 10 Drawing Sheets

INDIVIDUAL CYLINDER TUNING BOOSTER FOR A CARBURETOR

CROSS REFERENCE TO RELATED APPLICATION

The present application is a continuation-in-part of U.S. application Ser. No. 16/210,978, filed Dec. 5, 2018, now U.S. Pat. No. 10,830,183, the entirety of which is incorporated herein by reference.

FIELD

The present disclosure relates generally to a fuel discharge nozzle for distributing fuel in a carburetor.

BACKGROUND

Carburetors are used to deliver a fuel/air mixture to an engine (e.g., internal combustion engine) for combustion. Carburetors typically include a main body through which a stream of air from the air intake passes to the manifold, and one or more fuel discharge nozzles which delivers gasoline into the air stream to create the fuel/air mixture. The fuel discharge nozzles receive fuel from a fuel bowl holding a reservoir of gasoline that is coupled to the main body of the carburetor. The fuel is aspirated from the fuel discharge nozzle by a venturi created in the air stream by the main body of the carburetor. Carburetors include a throttle valve (or "base plate") located downstream of the fuel discharge nozzle to control the amount of fuel/air mixture delivered to the cylinders of the engine.

SUMMARY

In one aspect of the present invention a fuel discharge nozzle for discharging fuel into an airflow passageway of a barrel of a carburetor generally comprises an elongate nozzle body configured to be attached to the carburetor and having proximal and distal ends. The nozzle body has an airfoil shape and defines a fuel inlet configured to receive fuel, at least one fuel outlet configured to permit the fuel to flow out of the nozzle, and a fuel passage fluidly connecting the fuel inlet and the fuel outlet so that the fuel can flow from the fuel inlet to the fuel outlet. The nozzle positions the fuel outlet in the airflow passageway of the barrel of the carburetor so that the fuel flows into the airflow passageway of the carburetor and mixes with air as the fuel flows through the fuel outlet.

In another aspect of the present invention, a carburetor for an internal combustion engine having at least at least two combustion cylinders generally comprises a body having at least one barrel formed therein defining an airflow passageway for the passage of air from outside the carburetor into the two cylinders of the internal combustion engine when the carburetor is attached to the internal combustion engine. A throttle valve disposed in the barrel for controlling the amount of fuel and air that is passed from the barrel to the cylinders of the internal combustion engine is constructed so that air and fuel flow on opposite sides of the throttle valve. A nozzle mounted on the carburetor body and extending transversely across the barrel upstream of the throttle valve has an airfoil shape. The nozzle defines a fuel inlet configured to receive fuel, at least one fuel outlet disposed between the proximal and distal ends of the nozzle and configured to permit the fuel to flow out of the nozzle, and a fuel passage fluidly connecting the fuel inlet and the fuel outlet so that the fuel can flow from the fuel inlet to the fuel outlet. The nozzle positions the fuel outlet in the airflow passageway of the barrel of the carburetor so that the fuel flows into the airflow passageway of the carburetor and mixes with air as the fuel flows through the fuel outlet.

In still another aspect of the present invention, a method of tuning a carburetor to provide fuel/air mixtures to two cylinders of an internal combustion engine fed by a single barrel of the carburetor generally comprises determining that a fuel/air mixture from the carburetor to at least one of the two cylinders deviates from a standard fuel/air mixture. A nozzle is installed into the carburetor that is constructed to deliver a different amount of fuel on one side of an airflow passageway of the barrel than on the other side of the airflow passageway of the barrel to bring the fuel/air mixture of at least one of the two cylinders closer to the standard fuel/air mixture.

BRIEF DESCRIPTION OF THE DRAWINGS

Corresponding reference characters indicate corresponding parts throughout the drawings.

DETAILED DESCRIPTION

Figure 1:
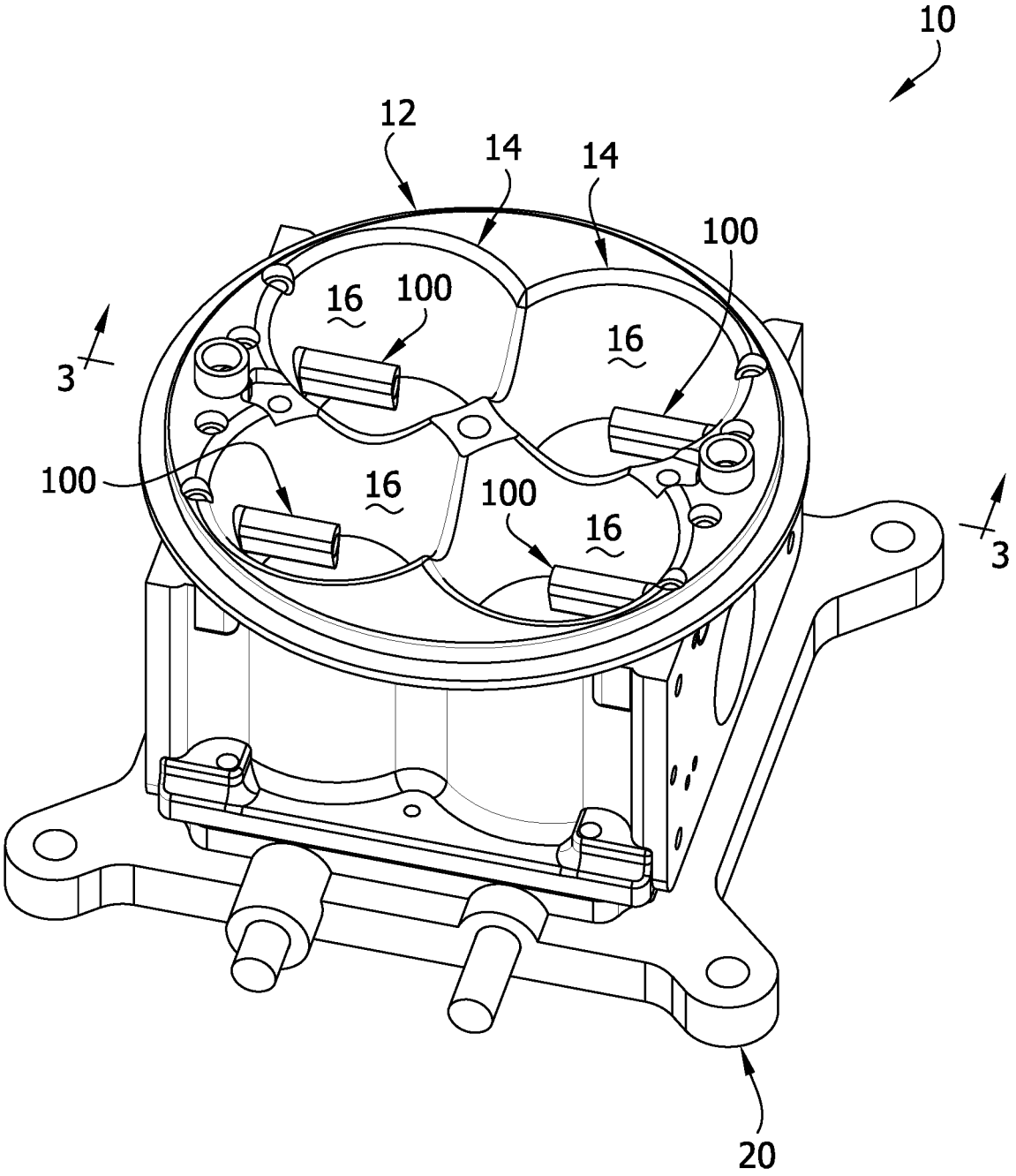
FIG. 1 is a perspective of one embodiment of a carburetor according to the teachings of the present disclosure.
Figure 2:
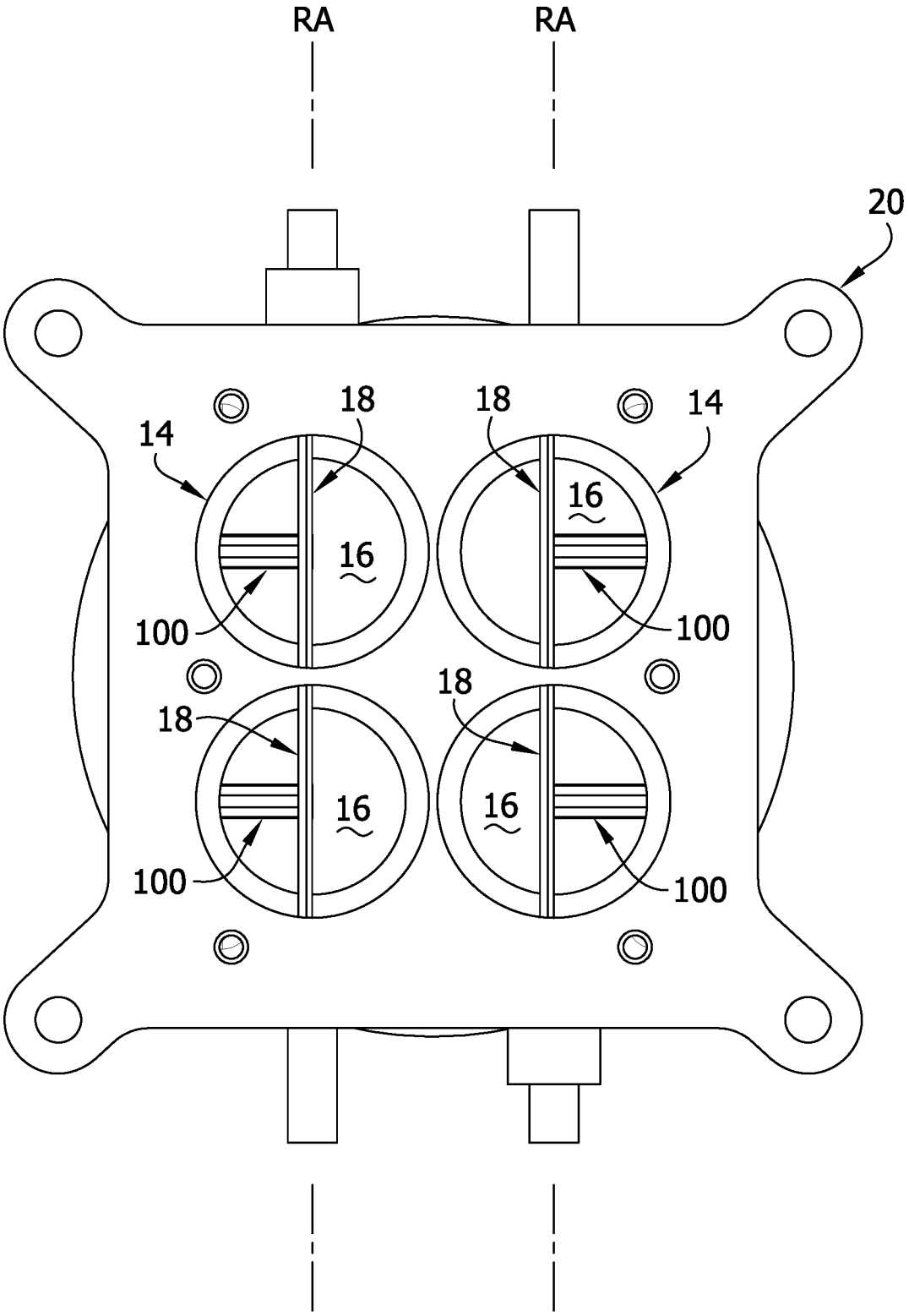
FIG. 2 is a bottom view thereof.
Figure 3:
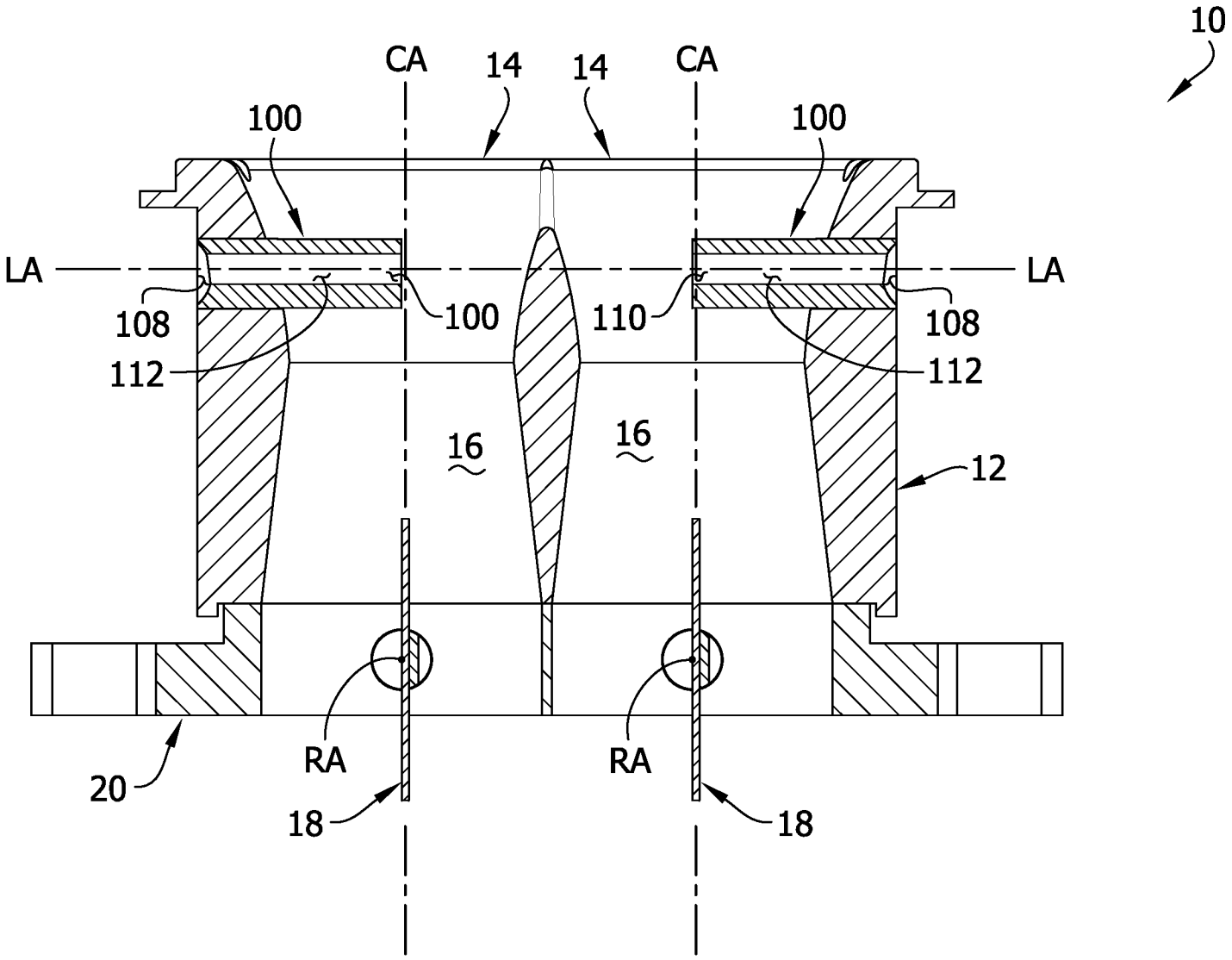
FIG. 3 is a section view taken through line 3-3 in FIG. 1.
Figure 4:
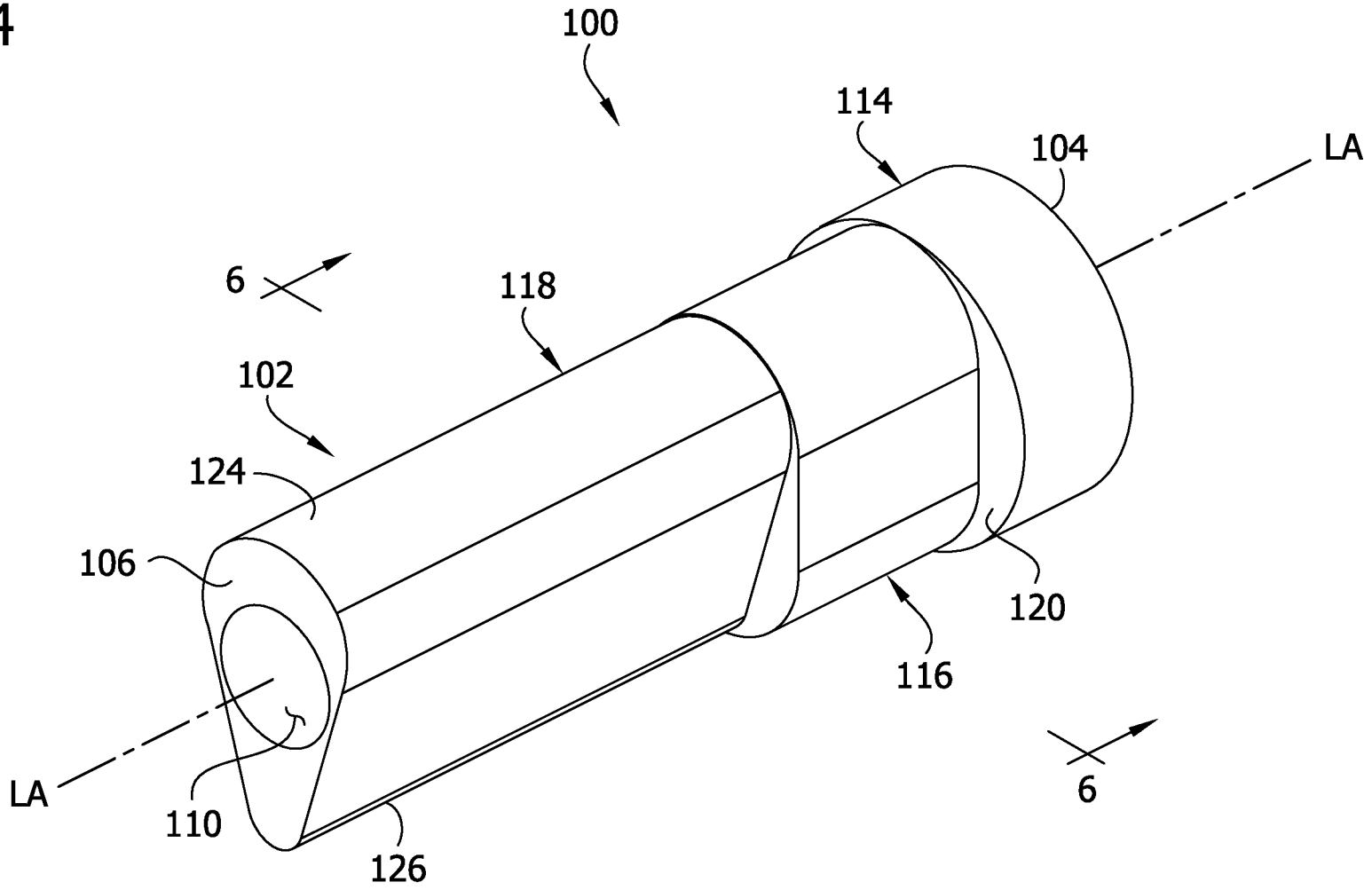
FIG. 4 is a top perspective of a fuel discharge nozzle according to one embodiment of the present disclosure.
Figure 5:
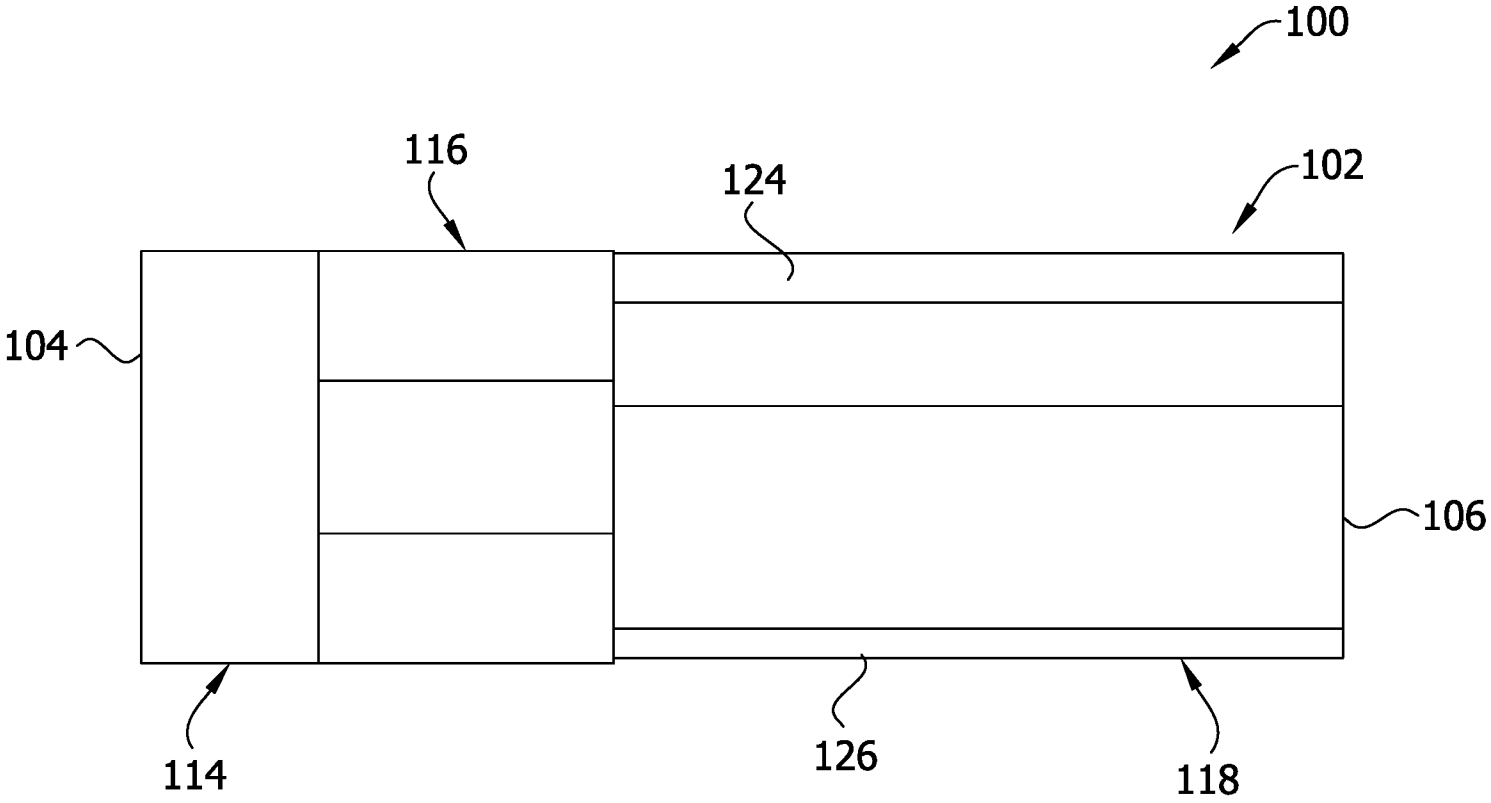
FIG. 5 is a left side view of the fuel discharge nozzle, the right side view being a mirror image thereof.

Referring now to the drawings and in particular to FIGS. 1-3, one embodiment of a carburetor according to the teachings of the present disclosure is generally indicated at 10. The carburetor 10 includes a main body 12 having four barrels 14 formed therein. Each barrel 14 defines an airflow passageway 16 for the passage of air from outside the carburetor 10 into two cylinders of the internal combustion engine (not shown) when the carburetor is attached to the internal combustion engine. The illustrated carburetor is a four barrel carburetor of the type used with an internal combustion engine for a vehicle having eight cylinders, with each barrel providing the fuel/air mixture to two of the cylinders. It is understood the carburetor can be any type of carburetor, having any number of barrels 14, used for any type of gasoline engine. The carburetor 10 includes a throttle valve 18 disposed in each of the barrels 14 for controlling the amount of fuel and air (e.g., fuel/air mixture) that is passed from the barrel to the cylinders of the internal combustion engine. The throttle valve 18 is constructed so that fuel/air mixture flows on opposite sides of the throttle valve. For a barrel 14 that supplies the air/fuel mixture to two cylinders of the engine, generally, the portion of the fuel/air mixture that flows on (e.g., around) one side of the throttle valve 18 feeds one cylinder of the engine and the portion of the fuel/air mixture that flows on the other side of the throttle valve feed the another cylinder of the engine. Each throttle valve 18 is rotatably attached to a throttle valve housing 20 secured to the main body 12. The throttle valve housing 20 defines a portion of each barrel 14. In the illustrated embodiment, each throttle valve 18 is a butterfly valve. It is understood the throttle valve can be any type of throttle valve used in any type of carburetor. The orientation of the carburetor 10 in FIG. 1 provides the point of reference for the terms defining relative locations and positions of structures and components of the carburetor, including but not limited to the terms "upper," "lower," "left," "right," "top," "bottom," "forward," and "rearward," as used throughout the present disclosure. However, it is to be understood that other orientations and positions of the components may be used within the scope of the present invention.

An elongate fuel discharge nozzle (e.g., nozzle), generally indicated at 100, is disposed within each barrel 14 for discharging fuel into the airflow passageway 16 of the barrel of the carburetor 10. The fuel discharge nozzle may also be referred to as an individual cylinder tuning booster. As will be described in more detail below, each nozzle 100 has a configuration particularly selected to provide substantially the same fuel/air mixture to the two internal combustion engine cylinders fed by the barrel 14 of the carburetor 10. As is generally known in the art, each fuel discharge nozzle 100 receives fuel from a fuel bowl or other fuel source (not shown) and discharges the fuel into the airflow passageway where the fuel mixes with air flowing through the airflow passageway to form the fuel/air mixture. Each nozzle 100 is mounted on the main body 12 and extends transversely across the barrel 14 (e.g., extends perpendicularly to a central axis CA defined by the barrel) upstream of the throttle valve 18. The nozzle 100 extends through and pass the center (e.g., central axis CA) of the barrel 14. The nozzle 100 also extends in a direction that is generally perpendicular to a rotational axis RA of the throttle valve 18. As shown in FIG. 3, the nozzle 100 is disposed in the airflow passageway 16 upstream of the constriction (e.g., smallest cross-sectional area) of the barrel 14 that generates the venturi. In addition to the nozzle 100, and acceleration pump (not shown) has an outlet above the location of the nozzle to supply additional fuel to the barrel during acceleration.

Referring to FIGS. 4-7, the nozzle 100 includes a nozzle body 102 configured to be attached to the main body 12 of the carburetor 10. The nozzle body 102 has proximal and distal ends 104 and 106, respectively, and defines a longitudinal axis LA extending between the proximal and distal ends. The distal end 106 is configured to be positioned in the airflow passageway 16 of the barrel 14. As shown in FIG. 3, when coupled to the main body 12, the longitudinal axis LA of the nozzle 100 extends through and generally perpendicular to the central axis CA of the barrel 14. The nozzle body 102 defines a fuel inlet 108 (FIG. 3) configured to the receive fuel. For example, the fuel inlet 108 is fluidly coupled to one of the fuel bowls (not shown) that supplies fuel to the carburetor 10. The fuel inlet 108 is disposed on the proximal end 104 of the nozzle body 102.

The nozzle body 102 defines a fuel outlet generally indicated at 110 configured to permit fuel to flow out of the nozzle body. The fuel outlet 110 is located at the distal end 106 of the nozzle body 102. When mounted on the main body 12, the fuel outlet 110 is in open fluid communication with the airflow passageway 16 of the barrel 14 of the carburetor 10. The nozzle body 102 is sized and shaped to position the fuel outlet 110 in the airflow passageway 16 when the nozzle body is attached to the carburetor 10 so that the fuel flows into the airflow passageway of the carburetor and mixes with the air after the fuel flows out of the fuel outlet. As shown in FIG. 3, when the nozzle 100 is attached to the main body 12, the nozzle positions the fuel outlet 110 at a particular location along a line transverse to the central axis CA in the airflow passageway 16 of the barrel 14. The location of the outlet 110 affects how much fuel flows on each side of the barrel 14. This affects who much fuel reaches each of the two cylinders fed from the barrel 14.

The nozzle body 102 defines a fuel passage 112 that fluidly connects the fuel inlet 108 and the fuel outlet 110 so that fuel can flow from the fuel inlet to the fuel outlet. The fuel passage 112 extends from the proximal end 104 of the nozzle body 102 to the distal end 106. The fuel inlet 108 is located at the proximal end of the fuel passage 112, and the fuel outlet is located at the distal end 106 of the fuel passage. The fuel passage 112 is generally parallel to the longitudinal axis LA. In the illustrated embodiment, the fuel passage 112, fuel inlet 108 and fuel outlet 110 have circular cross-sectional shapes, although other shapes are within the scope of the present disclosure. When attached, the fuel outlet 110 deliver fuel outward, transverse to the flow direction of the air in the airflow passage 16 of the barrel 14. Although a single fuel outlet is shown, more than one outlet may be provided in the nozzle body 112 within the scope of the present invention. For example and without limitation, several smaller openings could be provided in the distal end 106 of the nozzle body 112 instead of the single larger outlet 110.

The nozzle body 102 includes a base portion 114, an extension portion 116 and a fuel delivery portion 118. The base portion 114 extends distally from the proximal end 104 of the nozzle body 102 is received in and engages the main body 12 of the carburetor. The base portion 114 includes a shoulder 120 that engages the main body 12 to position the nozzle 100 on the main body of the carburetor 10. In one embodiment, the base portion 114 and our extension portion are press fit into the carburetor main body 12 so that the nozzle 100 is sealed with the carburetor main body. The base portion 114 defines the fuel inlet 108 and a portion of the fuel passage 112. The extension portion 116 is sized and shaped to extend through a corresponding opening defined by a wall of the barrel 14. The extension portion 116 extends distally from the base portion 114 and defines a portion of the fuel passage 112. The fuel delivery portion 118 is sized and shaped to be disposed in the airflow passageway 16 of the carburetor 10 when the nozzle body 102 is attached to the carburetor. The fuel delivery portion 118 is configured to be inserted through an opening defined by the wall of the barrel 14 and positioned in the airflow passageway 16 when the base portion 114 engages the main body 12. The fuel delivery portion 118 extends distally from the extension portion 116 to the distal end 106 of the nozzle 100. The fuel delivery portion 118 defines the fuel outlet 110 and a portion of the fuel passageway 112.

Figure 6:
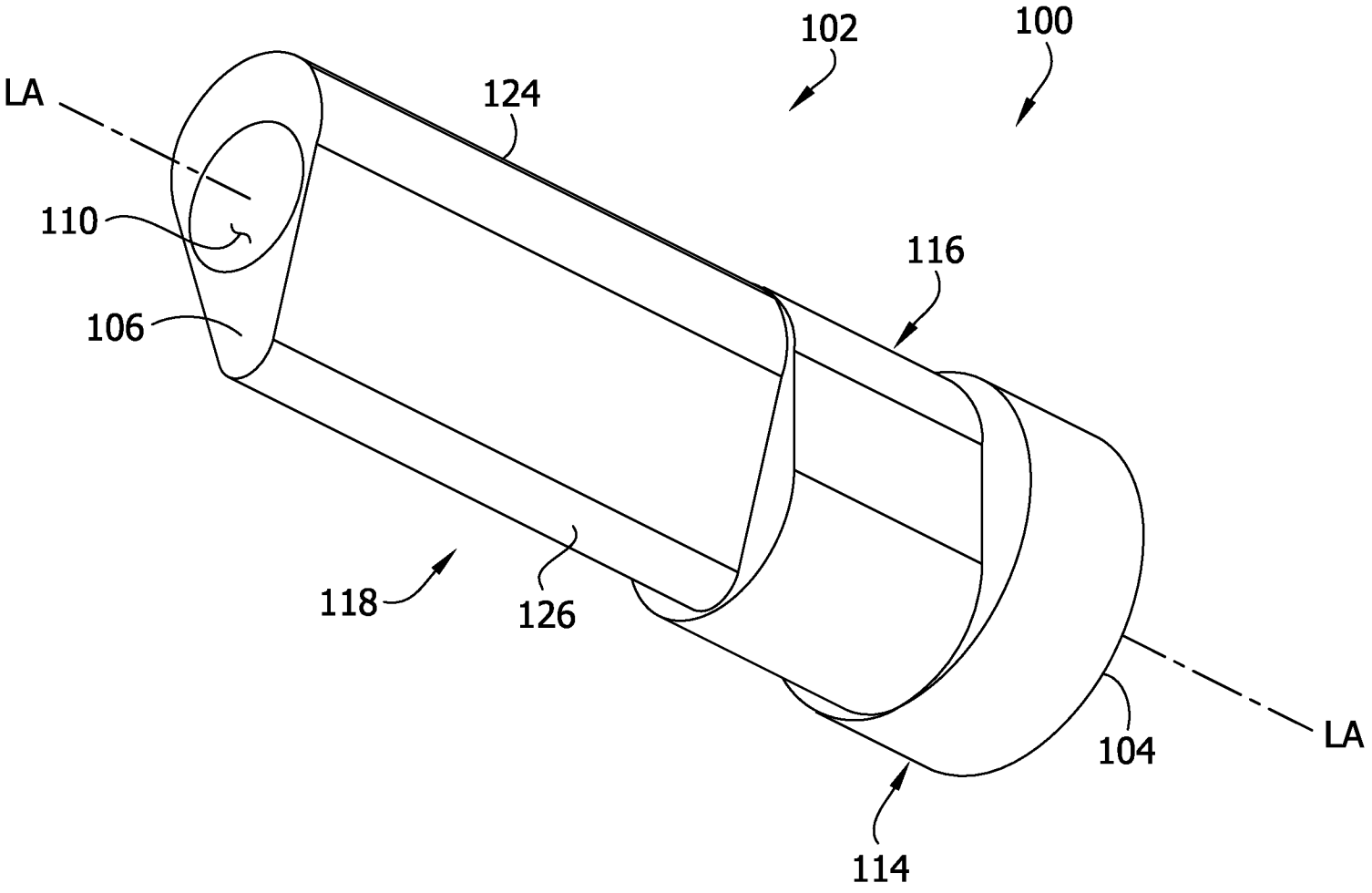
FIG. 6 is a bottom perspective of the fuel discharge nozzle.
Figure 7:
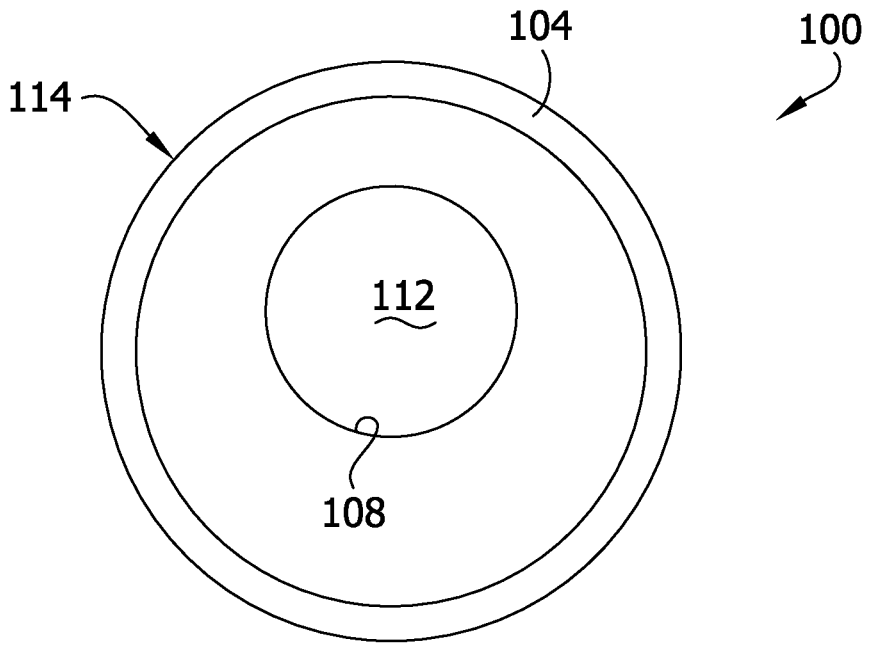
FIG. 7 is a rear view thereof.
Figure 8:
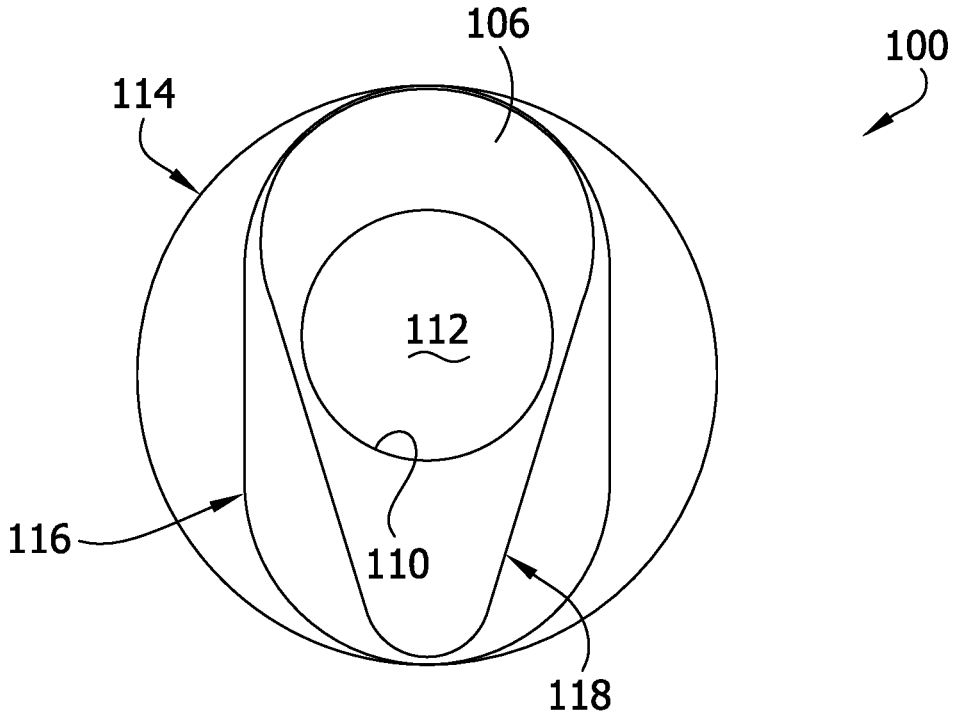
FIG. 8 is a front view thereof.
Figure 9:
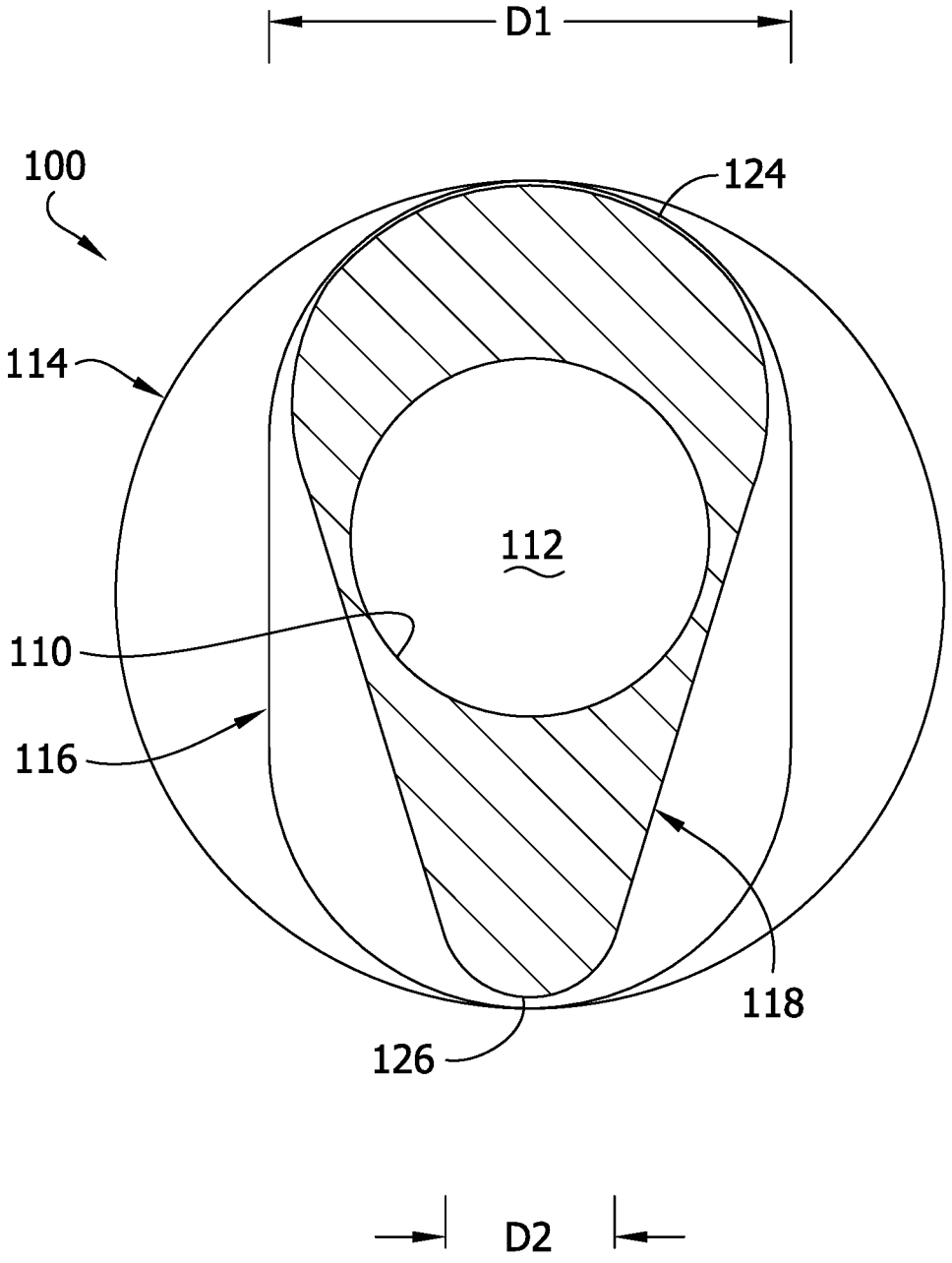
FIG. 9 is a section view taken through line 6-6 in FIG. 4.
Figure 10:
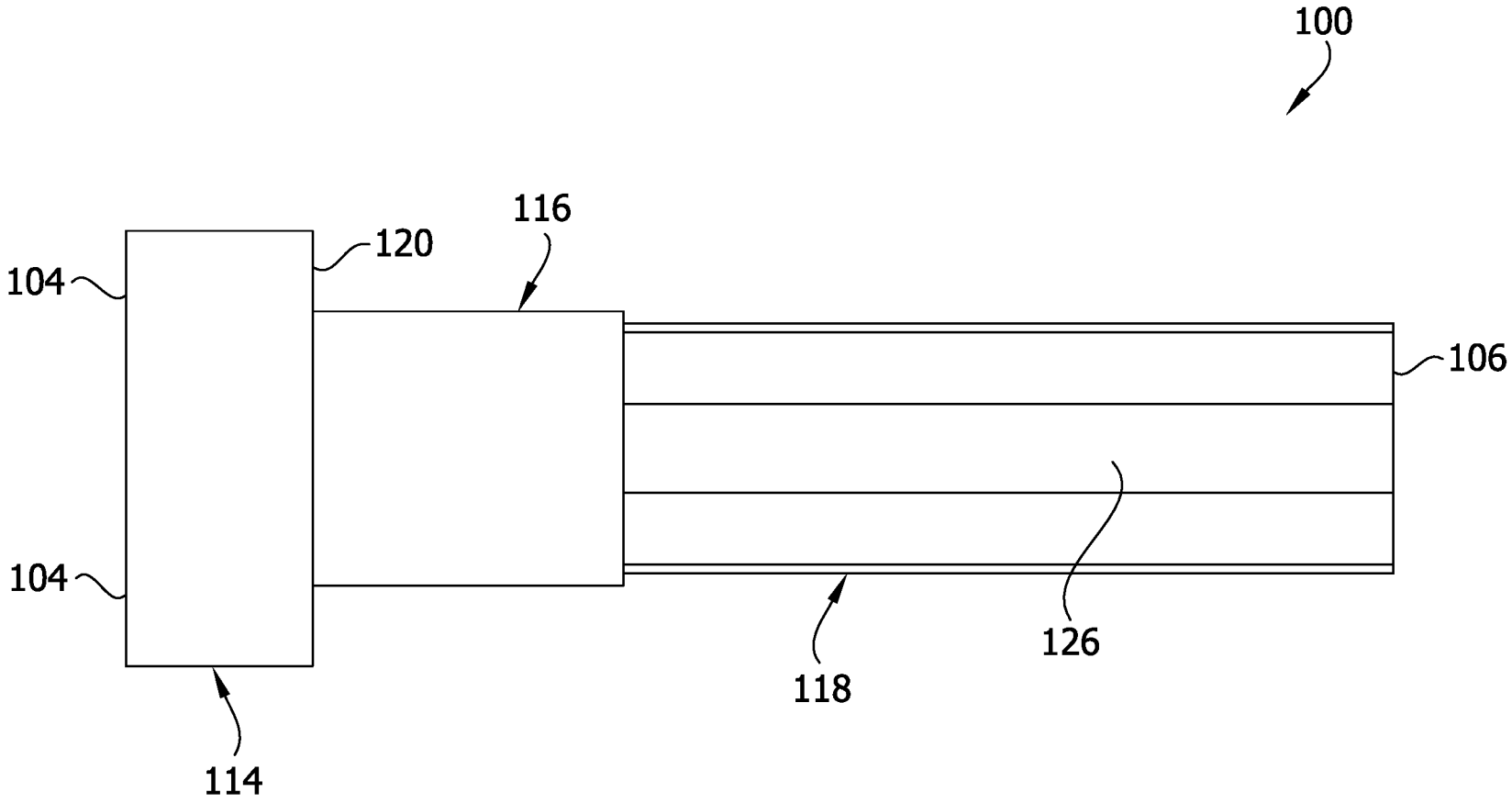
FIG. 10 is a bottom view thereof.

Referring to FIGS. 1 and 4-9, the fuel delivery portion 118 of the nozzle 100 has an airfoil shape configured to reduce turbulence caused by the passage of air in the airflow passageway 16 of the barrel 14 over the fuel delivery portion of the nozzle body 102 when the nozzle body is attached to the carburetor 10. As shown in FIG. 3, the nozzle 100, and more specifically the fuel delivery portion 118, extends in direction in the airflow passageway 16 that is generally perpendicular to the flow direction of the air through the airflow passageway when the nozzle is attached to the main body 12 of the carburetor 10. In the illustrated embodiment, the flow direction of the air is generally downward through each barrel 14. Accordingly, the longitudinal axis LA of the fuel delivery portion 118 of the nozzle 100 is generally perpendicular to the flow direction of the air. The outlet 110 opens to the air passageway 16 in the same direction as the longitudinal axis LA of the fuel delivery portion. An end face of the fuel delivery portion 118 containing the outlet 110 lies in a vertical plane generally parallel to the flow direction of air in the airflow passageway. The fuel delivery portion 118 has an arcuate upper edge section 124 (e.g., leading edge section) and an opposite arcuate lower edge section 126 (e.g., trailing edge section). The fuel outlet 110 is located at the distal end 106 of the nozzle body, and opens outward perpendicular to the flow direction of the air into the barrel. The fuel delivery portion 118 has a dimension D1 transverse to the longitudinal axis LA at the upper edge section 124 that is greater than a dimension D2 transverse to the longitudinal axis at the lower edge section 126 (FIG. 6). The fuel delivery portion 118 tapers from the upper edge section 124 to the lower edge section 126. Accordingly, a dimension transverse the longitudinal axis LA of the fuel delivery portion 118 tapers from the upper edge section 124 to the lower edge section 126. As illustrated, the tapering extends to a bottom edge of the fuel delivery portion 118.

The nozzle 100 is configured to provide the same fuel/air mixture to the two cylinders of the engine fed by the barrel 14 is the nozzle is disposed in. As mentioned above, each portion of the fuel/air mixture that flows on either side of throttle valve 18 feeds one of the cylinders of the engine. In currently existing carburetors, each cylinder fed by a single barrel of a carburetor typically receives different (e.g., unequal) fuel/air mixtures from the single barrel. Specifically, the distribution of fuel in the fuel/air mixture may not be uniform when the fuel/air mixture from the barrel reaches the cylinders. For example, for two cylinders fed by a single barrel, one cylinder may receive a fuel rich fuel/air mixture and the cylinder may receive a fuel lean fuel/air mixture. This unequal distribution of fuel prevents the cylinders and therefore the engine from operating at peak performance. The unequal distribution of the fuel/air mixture may be caused for a variety of factors, including but not limited to, the non-uniform flow of air into and through the airflow passageway, the throttle valve and the turbulence caused by the components through which the air and fuel/air mixture flows. In racing, banking of turns uniformly tends to place the same side of the engine block lower than the other in every turn, which can also affect in a regular manner how much fuel is fed to the high cylinder and the low cylinder in a turn. Moreover, it is appreciated that these factors further move and redistribute the fuel discharged into the fuel passageway 16 as the fuel/air mixture flows to the cylinders of the engine, which may result in an equal or, more likely, unequal distribution of fuel in the fuel/air mixture. Accordingly, the exact distribution of the fuel/air mixture between cylinders fed by a single barrel of a carburetor may be unique to that barrel, with each barrel in the carburetor having a different distribution of the fuel/air mixture.

The nozzle 100, and other nozzles described herein, are configured to deliver fuel into the airflow passageway 16 of the barrel 14 in a manner that results in substantially the same (e.g., equal) distribution of fuel/air mixture being delivered to both cylinders fed by the barrel. Providing substantially the same fuel/air mixture to two cylinders of the engine fed by the barrel 14 of the carburetor 10 increases the performance of the engine. It is understood the teachings herein can apply to a barrel of the carburetor feeding (e.g., supplying) a fuel/air mixture to more than two cylinders. Accordingly, a barrel of a carburetor feeding two or more cylinders of an engine, such as but not limited to three or four cylinders, is within the scope of the present disclosure.

The length of the fuel delivery portion 118 is selected position the outlet 110 for providing substantially the same fuel/air mixture to two internal combustion engine cylinders fed by the barrel 14 of the carburetor 10 when the nozzle body 102 is attached other carburetor mounted on a particular internal combustion engine. The exact location of the fuel outlet 110 depends upon the distribution of the fuel/air mixture between the two cylinders fed by each barrel 14, which can be determined by testing. The nozzle 100 can be biased to deliver equal or unequal distributions of fuel into each side of the airflow passageway 16. Specifically, the fuel outlet 110 can be positioned across the width of the barrel 14 so that in ideal circumstances fuel would be delivered into the airflow passageway 16 of the carburetor 10 in generally equal amounts on opposite sides of the throttle valve 18 of the carburetor when the nozzle body 102 is attached to the carburetor. Alternatively, the fuel outlet 110 can be positioned to bias fuel delivery toward an unequal distribution of fuel into the airflow passageway 16 of the carburetor 10 on opposite sides of the throttle valve 18 of the carburetor when the nozzle body 102 is attached to the carburetor. Other factors, such as the construction and operation of the engine and environmental factors result in the fact that biasing the delivery of fuel toward an unequal distribution actually results in the cylinders receiving fuel in more equal amounts.

Referring to FIGS. 3-10, the fuel outlet 110 is positioned by the length of the fuel delivery portion 118 to deliver fuel to each side of the airflow passageway 16. When attached to the main body 12, the longitudinal axis LA of the nozzle 100 extends generally transversely across the airflow passageway 16 (e.g., perpendicular to the central axis CA). The fuel delivery portion 118 provides the transverse position of the fuel outlet 110.

Figure 11:
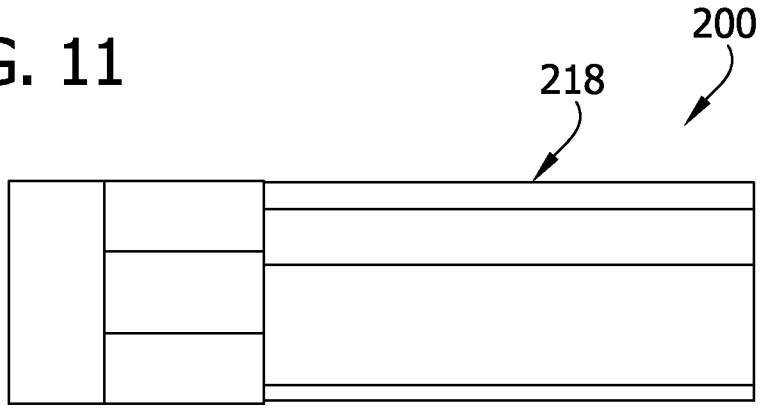
FIG. 11 is a left side elevation of another embodiment of a fuel discharge nozzle according to the teachings of the present disclosure.
Figure 12:
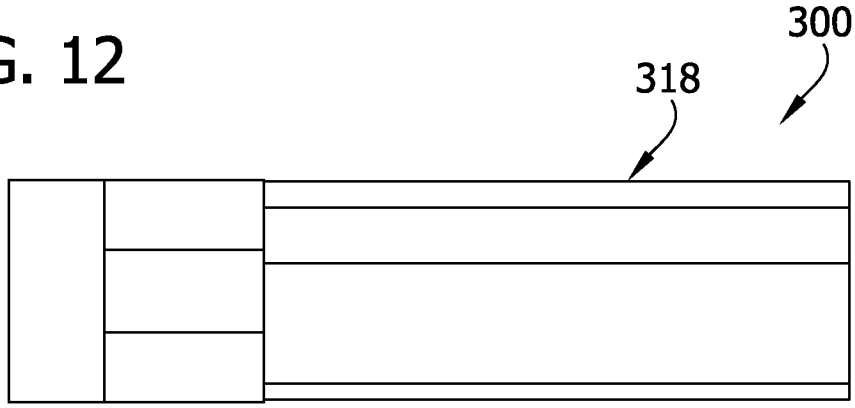
FIG. 12 is a left side elevation of another embodiment of a fuel discharge nozzle according to the teachings of the present disclosure.
Figure 13:
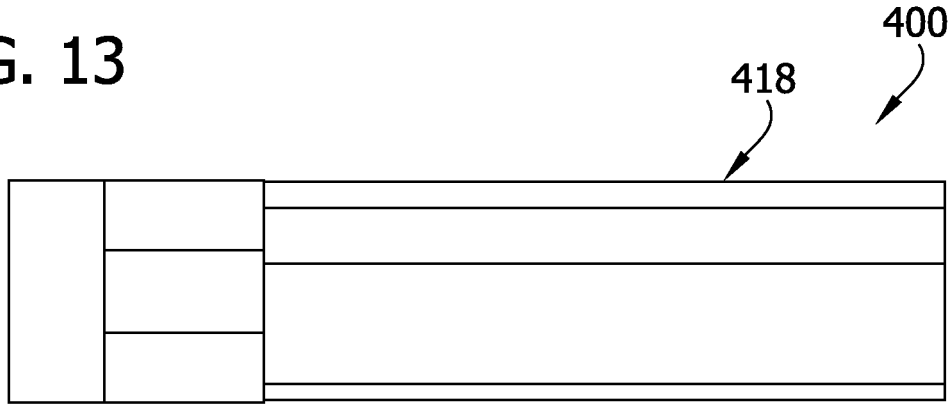
FIG. 13 is a left side elevation of another embodiment of a fuel discharge nozzle according to the teachings of the present disclosure.

Referring now to FIGS. 11-13, a set of nozzles 200, 300, 400 may be provided for tuning engines to achieve a desired fuel/air mixture in each cylinder of the engine fed by a particular barrel 14. Nozzle 100 may also be included in such a set, which may include any number of nozzles (or only one nozzle). Referring also to FIG. 3, it will be understood that by selecting a nozzle 100-400 having a fuel delivery portion 118, 218, 318, 418 of a particular length the location of the outlet 110. As shown in FIG. 3, the outlet 110 is position very near the middle of the barrel 14 in the airflow passageway 16. Selecting a nozzle (e.g., nozzle 200) have a shorter fuel delivery portion 218 places the outlet more on one side or the other of the central axis CA, or stated another way more on one side or the other of the throttle valve 18. The position of the outlet biases fuel delivery more to the side on which the outlet is located. If the outlet 110 is at the center, then there is effectively no bias. The construction and operation of the particular engine and use of the engine in particular environment (e.g., as with banked turns), can be affected by the bias to produce more nearly equal fuel distribution to the cylinders (or produce whatever fuel/air mix between the cylinders that is desired). For each twenty five thousandths of an inch change in length of the fuel delivery portion 118, 218, 318, 418 of the nozzle 100, 200, 300, 400, there is a change in the difference in fuel/air ratio to the two cylinders fed by the barrel 14 of about 0.2. This allows for very precise control of the fuel/air mix among the cylinders fed through the same barrel 14. More generally, it is believed that a change in length of about twenty five thousandths of an inch results in a change in the difference between the fuel/air ratio between the cylinders fed by the same barrel of between about 0.1 and 0.3. In another embodiment a change in length of about twenty five thousandths of an inch results in a change in the difference between the fuel/air ratio between the cylinders fed by the same barrel of between about 0.05 and 0.4.

To tune the carburetor 10 to provide fuel/air mixtures to the two cylinders of the internal combustion engine fed by each barrel 14 of the carburetor the user must first determine that a fuel/air mixture from the carburetor to each of the two cylinders deviates from a standard (e.g., optimal) fuel/air mixture. This determination may be made using tests and techniques generally known in the art. For example an engine may be attached to an engine dynamometer that provides data on torque, horsepower, pressure and fuel/air mixture in the individual cylinders. The tests and techniques used to determine the deviation can also provide values indicating whether the fuel/air mixture delivered to each cylinder is either rich or lean when compared to the standard fuel/air mixture. Once the cylinders receiving a rich fuel/air mixture and a lean fuel/air mixture are identified, the user selects a nozzle 100-400 with a fuel delivery portion 118-418 that will position the outlet (e.g., outlet 110) that will initially distribute the fuel into the sides of the airflow passageway 16 in such a way that will bring the fuel/air mixture delivered to at least one of the cylinders closer to the standard air/fuel mixture. In other words, the user installs a nozzle into the carburetor that is constructed to deliver a different amount of fuel on one side of the airflow passageway 16 of the barrel 14 than the other side of the airflow passageway to bring the fuel/air mixture of at least one of the two cylinders closer to the standard fuel/air mixture. In some embodiments, the selected nozzle may bring both cylinders closer to the standard fuel/air mixture.

For example, if the portion of the fuel/air mixture flowing on the distal side of the throttle valve 18 and going to one cylinder is lean and the portion of the fuel/air mixture flowing on the proximal side of the throttle valve and going to the other cylinder is rich, the user may select or fabricate a nozzle (e.g., nozzle 300, 400) having a longer fuel delivery portion (318, 418), which deliver more fuel to the distal side and less fuel to the proximal side of the airflow passageway 16. In this example, the exact nozzle selected to be mounted on carburetor 10 (which may be other than the illustrated nozzles 100-400) depends upon the difference between the rich and lean portions of the fuel/air mixture with the standard fuel/air mixture and which nozzle will deliver the appropriate proportions of the fuel to each side of the airflow passageway 16 such that by the time the fuel/air mixture is directed into each cylinder, substantially the same fuel/air mixture (e.g., standard fuel mixture) is delivered to both cylinders. It is appreciated that both cylinders may receive a rich or lean fuel/air mixture, which may indicate an inappropriate amount of fuel is entering the airflow passageway 16, instead of or in addition to the fuel/air mixture being unequally distributed between the cylinders. The nozzles 100-400 are configured to be retrofit into existing carburetors.

Tests conducted on engines having a carburetor outfitted with the nozzles described herein demonstrated increased performance. Specifically, tests were conducted with engines having a horsepower between 700 hp and 900 hp before the addition of the nozzles 100-700. The fuel/air mixture being delivered to each cylinder was determined and then the existing nozzles in the carburetor of each engine were replaced with nozzles 100-700, as described herein. As a result, the horsepower generated by each engine having a carburetor outfitted with nozzles 100-700 significantly increased by about 25-30 hp.

Having described the invention in detail, it will be apparent that modifications and variations are possible without departing from the scope of the invention defined in the appended claims. For example, where specific dimensions are given, it will be understood that they are exemplary only and other dimensions are possible.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A fuel discharge nozzle for discharging fuel into an airflow passageway of a barrel of a carburetor, the fuel discharge nozzle comprising:

an elongate nozzle body configured to be attached to the carburetor and having proximal and distal ends, the nozzle body having an airfoil shape and defining a fuel inlet configured to receive fuel, a fuel outlet configured to permit the fuel to flow out of the nozzle, and a fuel passage fluidly connecting the fuel inlet and the fuel outlet so that the fuel can flow from the fuel inlet to the fuel outlet, the nozzle positioning the fuel outlet in the airflow passageway of the barrel of the carburetor so that the fuel flows into the airflow passageway of the carburetor and mixes with air as the fuel flows through the fuel outlet.

2. The fuel discharge nozzle as set forth in claim 1, wherein the nozzle body comprises a fuel delivery portion sized and shaped to be disposed in the airflow passageway, the fuel delivery portion having the airfoil shape, the airfoil shape of the fuel delivery portion being configured to reduce turbulence caused by passage of air in the airflow passageway over the fuel delivery portion of the nozzle body when the nozzle body is attached to the carburetor.

3. The fuel discharge nozzle as set forth in claim 2, wherein the nozzle body is configured to be installed in the carburetor so that a leading edge of the airfoil shaped fuel delivery portion is located at a top of the nozzle body and a trailing edge of the airfoil shaped fuel delivery portion is located at a bottom of the nozzle body.

4. The fuel discharge nozzle as set forth in claim 2, wherein the leading edge of the fuel delivery portion has a greater thickness than the trailing edge thereof.

5. The fuel discharge nozzle as set forth in claim 4, wherein the thickness of the fuel delivery portion tapers from the leading edge to the trailing edge.

6. The fuel discharge nozzle as set forth in claim 2, wherein the nozzle body is configured to locate the fuel outlet within the barrel of the carburetor to bias the delivery of fuel leaving the fuel outlet toward a selected side of the barrel when the nozzle body is attached to the carburetor.

7. The fuel discharge nozzle as set forth in claim 2, wherein the fuel delivery portion is configured to extend in a direction in the airflow passageway that is generally perpendicular to a flow direction of the flow of air through the airflow passageway when the nozzle body is attached to the carburetor such that a longitudinal axis of the fuel delivery portion is generally perpendicular to the flow direction.

8. A set of fuel delivery nozzles comprising fuel delivering nozzles as set forth in claim 1 wherein at least two of the nozzles in the set have a nozzle body having different lengths.

9. The fuel discharge nozzle as set forth in claim 1, wherein the fuel outlet is disposed at the distal end of the elongate nozzle body.

10. A carburetor for an internal combustion engine having at least at least two combustion cylinders, the carburetor comprising:

a body having at least one barrel formed therein defining an airflow passageway for the passage of air from outside the carburetor into the two cylinders of the internal combustion engine when the carburetor is attached to the internal combustion engine, a throttle valve disposed in the barrel for controlling the amount of fuel and air that is passed from the barrel to the cylinders of the internal combustion engine, the throttle valve being constructed so that air and fuel flow on opposite sides of the throttle valve, and a nozzle mounted on the carburetor body and extending transversely across the barrel upstream of the throttle valve, the nozzle having an airfoil shape and defining a fuel inlet configured to receive fuel, a fuel outlet at a distal end of the nozzle and configured to permit the fuel to flow out of the nozzle, and a fuel passage fluidly connecting the fuel inlet and the fuel outlet so that the fuel can flow from the fuel inlet to the fuel outlet, the nozzle positioning the fuel outlet in the airflow passageway of the barrel of the carburetor so that the fuel flows into the airflow passageway of the carburetor and mixes with air as the fuel flows through the fuel outlet.

11. The carburetor as set forth in claim 10, wherein the nozzle comprises a nozzle body including a fuel delivery portion sized and shaped to be disposed in the airflow passageway, the fuel delivery portion having the airfoil shape, the airfoil shape of the fuel delivery portion being configured to reduce turbulence caused by passage of air in the airflow passageway over the fuel delivery portion of the nozzle body when the nozzle body is attached to the carburetor.

12. The carburetor as set forth in claim 11, wherein the nozzle body is configured to be installed in the carburetor so that a leading edge of the airfoil shaped fuel delivery portion is located at a top of the nozzle body and a trailing edge of the airfoil shaped fuel delivery portion is located at a bottom of the nozzle body.

13. The carburetor as set forth in claim 11, wherein the leading edge of the fuel delivery portion has a greater thickness than the trailing edge thereof.

14. The carburetor as set forth in claim 13, wherein the thickness of the fuel delivery portion tapers from the leading edge to the trailing edge.

15. The carburetor as set forth in claim 11, wherein the nozzle body is configured to locate the fuel outlet within the barrel of the carburetor to bias delivery of fuel toward an unequal distribution of fuel into the airflow passageway of the carburetor on opposite sides of a throttle valve of the carburetor when the nozzle body is attached to the carburetor.

16. The carburetor as set forth in claim 11, wherein the fuel delivery portion is configured to extend in a direction in the airflow passageway that is generally perpendicular to a flow direction of the flow of air through the airflow passageway when the nozzle body is attached to the carburetor such that a longitudinal axis of the fuel delivery portion is generally perpendicular to the flow direction.

17. A method of tuning a carburetor to provide fuel/air mixtures to two cylinders of an internal combustion engine fed by a single barrel of the carburetor, the method comprising:

determining that a fuel/air mixture from the carburetor to at least one of the two cylinders deviates from a standard fuel/air mixture;

selecting from a set of nozzles, each nozzle of the set of nozzles constructed to deliver fuel to an airflow passageway of the barrel, a nozzle that will deliver fuel to the airflow passageway of the barrel at a location that will bring the fuel/air mixture of at least one of the two cylinders closer to the standard fuel/air mixture, wherein the location each nozzle of the set of nozzles is constructed to deliver fuel to is different; and installing the selected nozzle into the carburetor.

18. The method as set forth in claim 17, wherein each nozzle the set of nozzles has a different length, the length of each nozzle corresponding to the location in the air flow passageway each nozzle will deliver fuel to.

* * * * *